US006520178B1

(12) United States Patent
Baker

(10) Patent No.: US 6,520,178 B1
(45) Date of Patent: Feb. 18, 2003

(54) AIR AND WATER HOSE APPARATUS FOR FIREFIGHTERS

(75) Inventor: Fred E. Baker, Eaton Rapids, MI (US)

(73) Assignee: Robert E. McCarthy, East Lansing, MI (US)

( * ) Notice: Subject to any disclaimer, the term of this patent is extended or adjusted under 35 U.S.C. 154(b) by 72 days.

(21) Appl. No.: 09/802,597

(22) Filed: Mar. 9, 2001

(51) Int. Cl.[7] ..... A62B 9/04

(52) U.S. Cl. ..... 128/202.27; 128/205.05; 128/204.18; 128/205.24

(58) Field of Search ..... 128/201.25, 201.29, 128/202.27, 205.25, 205.22, 205.21, 205.24, 202.19, 202.11, 204.18, 911, 912, 207.14, 207.15, 207.16, 207.17, 207.18; 138/114, 109

(56) References Cited

U.S. PATENT DOCUMENTS

| | | | | |
|---|---|---|---|---|
| 174,286 A | * | 2/1876 | Ostberg | |
| 386,751 A | | 7/1888 | Loomis | |
| 916,886 A | * | 3/1909 | Merryman | |
| 958,427 A | | 5/1910 | Panian | |
| 1,040,311 A | | 10/1912 | Halloran | |
| 1,084,958 A | * | 1/1914 | Panian | |
| 1,808,281 A | * | 6/1931 | Balthazor | |
| 2,515,578 A | | 7/1950 | Wilson et al. | |
| 4,367,769 A | * | 1/1983 | Bain | 138/103 |
| 4,649,912 A | | 3/1987 | Collins | |
| 4,650,471 A | * | 3/1987 | Tamari | 138/114 |
| 4,974,584 A | | 12/1990 | Goodnoe | |
| 5,095,899 A | * | 3/1992 | Green | 128/200.25 |

OTHER PUBLICATIONS

Self–Contained Breathing Apparatus, Second Edition, pp. 66–67.

* cited by examiner

*Primary Examiner*—Aaron J. Lewis
*Assistant Examiner*—Darwin P. Erezo
(74) *Attorney, Agent, or Firm*—Mary M. Moyne; Ian C. McLeod

(57) ABSTRACT

An air and water hose apparatus (10 or 210) for use in an air supply system (100) for firefighters (150). The air and water hose apparatus has an air hose (32 or 232) completely within the water hose (12 or 212). The air and water hose apparatus comprises only a single length of the overall water hose of the system. This ensures that no part of the air hose is exposed to possible damage. The system supplies high pressure air to the firefighters. The system allows for easy connect and disconnect of the air and water hose apparatus to the firefighter's mask (160) and preferably can be used with standard self-contained breathing apparatus (152) having a mask and a regulator (158). A branched conduit (46) allows several firefighters to be attached to a single air and water hose apparatus.

35 Claims, 6 Drawing Sheets

AIR AND WATER HOSE APPARATUS FOR FIREFIGHTERS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION (1) Field of the Invention

The present invention relates to an air and water hose apparatus and the method of using the air and water hose apparatus for use in a system to supply water and air to firefighters during a fire. In particular, the present invention relates to an air and water hose apparatus which has an internal air hose which connects to the mask of the firefighters to provide a constant source of air to the firefighter.

(2) Description of the Related Art

One of the dangers that firefighters face is being trapped or lost in the structure which is on fire. One of the main reasons that firefighters die in such a situation is that they run out of air. Currently, in most situations, air is supplied to the firefighter by tanks carried by the firefighter. Most of these tanks, due to their size and weight, have very limited air supply. Thus, if a firefighter is trapped for an extensive period of time, the supply is eventually exhausted which usually results in the death of the firefighter.

In the past, various system have been developed which try to supply air to a firefighter from a distant source. Illustrative are U.S. Pat. Nos. 386,751 to Loomis, 958,427 to Panian, 1,040,311 to Halloran and 4,974,584 to Goodnoe.

Loomis shows an apparatus which has an air tube combined with a fire hose. The outer end of the air tube connects with a flexible air-tube which connects to the mask of the firefighter. The air tube and fire hose have independent unions such that several sections of the apparatus can be connected together. When connecting the sections together, the air tube extends around the outside of the fire hose union. This design exposes the air tube to possible damage which could stop the flow of air through the tube. The air is supplied by an air pump. This system is only intended to operate using air at low pressures such as atmosphere pressure.

This system could not be used in conjunction with the compressed air systems currently used by firefighters. The air hoses of current compressed air systems has an inner diameter usually less than 1.0 inch (2.54 cm). The small size of the inner diameter of the air hose would not allow enough air at atmospheric pressure to travel through the air hose to support the firefighter.

Panian describes a respirating apparatus where the air is provided to the mask of the firefighter through a flexible tube which extends along the outside of the water hose. The air is supplied to the air tube by bellows which are actuated by water in the water hose rotating a wheel connected to the bellows. One of the disadvantages of this system is that the flow of air depends on the flow of water. If for any reason the water in the hose were to stop running, the firefighter's air supply would also stop. In addition, as with the apparatus of the Loomis reference, the positioning of the air tube on the outside of the water hose exposes the air tube to possible damage which could stop the flow of air through the tube. In current systems using high pressure, compressed air, air which leaks from a damaged air tube could potentially feed the fire.

Halloran shows an air supply device which uses an air suction chamber attached to one end of the fire hose. The air suction chamber is configured to draw fresh air into the chamber through a pipe due to the suction action of the water passing through the fire hose. Funnels in the chamber collect the air entering the air suction chamber and transfer the air through pipes to the firefighter's masks. However, this system is very unreliable. In addition, as with the apparatus of the Panian reference, if for any reason the water in the hose were to stop running, the firefighter's air supply would also stop.

Goodnoe describes an emergency air supply assembly for firefighters. In this invention, the water supply for the water hose is shut off and the emergency air is provided to the firefighter through the water hose. The end of the water hose is placed in an emergency air collector which collects the air. The firefighter then inserts his breathing tube into the air collector. This system is difficult to use. However, a more substantial disadvantage of this system is that the water must be turned off before air can be supplied. Thus, the firefighter must choose between having water to fight the fire and having air to breathe. Further, this system uses air at low pressures and can only be used as an emergency system.

Currently, as shown in the publication by the Fire Protection Publications Oklahoma State University entitled Second Edition, Self-Contained Breathing Apparatus, an air line can be provided to allow for a longer air supply than is provided by a self-contained breathing apparatus having a tank carried by the firefighter. This air line is attached at one (1) end to one or several air cylinders and is connected at the other end to an open circuit face piece, regulator, and egress cylinder of the firefighter. However, this air line is exposed and therefore is not intended to be used by a firefighter in a burning structure.

Also of interest is U.S. Pat. No. 2,515,578 to Wilson which describes a firefighting device which conducts mist or fog from the fluid stream within the nozzle to the mask of the firefighters.

Only of minimal interest is U.S. Pat. No. 4,649,912 to Collins which describes an air respirator system for painters. The air supply for the painter is removed from the compressed air line which supplies air to the paint sprayer from the compressor.

There remains the need for a system for supplying air to a firefighter from a distant source having an air tube completely inside of the water tube which allows for high pressure air to be delivered to firefighters without interfering with the flow of the water in the water hose and where the flow of air is not contingent on the flow of water.

SUMMARY OF THE INVENTION

The present invention provides a system which allows a hose apparatus to be used to deliver water and air to the firefighter at all times. The system eliminates the need for firefighters to rely on the limited amount of air supplied by their tanks when they are trapped in a structure. The system could result in firefighters carrying smaller air tanks which equates to less weight carried by the firefighter. The use of a separate air hose in the interior of the water hose allows both water and air to move through the hose apparatus simultaneously. The air and water hose apparatus comprises only a single section of the overall water hose of the system. This ensures that no part of the air hose is exposed to possible damage. The air hose is entirely protected within the water hose. The present system can be used as a primary air supply system allowing the air tanks carried by the firefighter to be used only for emergency purposes. Alternatively, the system can be used as an emergency system to be used when the air tanks carried by the firefighter have been exhausted. The system supplies high pressure air similar to that supplied by the tanks carried by firefighters. The system allows for easy connect and disconnect of the air supply to the firefighter's mask and preferably can be used with standard self-contained breathing apparatus used by firefighters and including a mask and a regulator. Thus, the firefighter can easily switch between the air and water hose apparatus and the standard air tanks. A branched conduit allows several firefighters or victims to be attached to a single air and water hose apparatus.

The present invention relates to a hose apparatus having an inlet adaptor having a first passageway, an outlet adaptor having a second passageway and connectable to a nozzle for dispensing water and a flexible water hose between and connected to the inlet and outlet adaptors, the improvement which comprises: a first fitting secured in a watertight connection through the inlet adaptor with an opening through the fitting into the first passageway and with a first tubular member which extends towards the water hose; a second fitting secured through the outlet adaptor in a watertight connection with an opening through the fitting into the second passageway with a second tubular member which extends towards the water hose, such that the first and second tubular members are open towards each other; a flexible gas hose for supplying a breathable gas connected between the tubular members inside of the water hose in a gas and watertight connection; a first quick connect and disconnect coupling on the first fitting for connecting a source of the breathable gas through the opening in the first fitting, the first tubular member, the flexible air hose, the second tubular member, and the opening in the second fitting, and for sealing the first fitting when disconnected and for providing the breathable gas when connected to the source of the breathable gas; and a second quick connect and disconnect coupling on the second fitting for connecting the breathable gas to a pressure regulator as part of a firefighter's mask and for sealing the second fitting when disconnected, wherein the gas hose is able to withstand an external water pressure in the water hose without collapsing and an internal pressure of the breathable gas of at least 125 psig.

Further, the present invention relates to a system for providing breathable air to a firefighter wearing a mask with an air pressure regulator along with providing water to fight a fire, the improvement which comprises: a hose apparatus having an inlet adaptor having a first passageway, an outlet adaptor having a second passageway and connectable to a nozzle for dispensing the water and a flexible water hose between and connected to the inlet and outlet adaptors, and further comprising: (i) a first fitting secured in a watertight connection through the inlet adaptor with an opening through the first fitting into the first passageway and with a first tubular member which extends towards the water hose; (ii) a second fitting secured through the second adaptor in a watertight connection with an opening through the fitting into the second passageway with a second tubular member which extends towards the water hose, such that the first and second tubular members are open towards each other; (iii) a flexible gas hose for supplying a breathable gas connected between the tubular members inside of the water hose in a gas and watertight connection; (iv) a first quick connect and disconnect coupling on the first fitting for connecting a source of the breathable gas through the opening in the first fitting, the first tubular member, the flexible air hose, the second tubular member, and the opening in the second fitting, and for sealing the first fitting when disconnected and for providing the breathable gas when connected to the source of the breathable gas; and (v) a second quick connect and disconnect coupling on the second fitting for connecting the breathable gas to the air pressure regulator of the mask and for sealing the second fitting when disconnected, wherein the gas hose is able to withstand an external water pressure in the water hose without collapsing and an internal pressure of the breathable gas of at least 125 psig; and a coupling hose for connecting between the air pressure regulator and the second quick disconnect coupling so that the breathable gas can be supplied to the firefighter by the system while water is flowing through the water hose.

Still further, the present invention relates to a method for fighting a fire which comprises the steps of: providing a hose apparatus having an inlet adaptor having a first passageway, an outlet adaptor having a second passageway and connectable to a nozzle for dispensing water and a flexible water hose between the inlet and outlet adaptors and further comprising: (i) a first fitting secured in a watertight connection through the inlet adaptor with an opening through the fitting into the first passageway and with a first tubular member which extends towards the water hose; (ii) a second fitting secured through the second adaptor in a watertight connection with an opening through the fitting into the second passageway with a second tubular member which extends towards the water hose, such that the first and second tubular members are open towards each other; (iii) a flexible gas hose for supplying a breathable gas connected between the tubular members inside of the water hose in a gas and watertight connection; (iv) a first quick connect and disconnect coupling on the first fitting for connecting a source of the breathable gas through the opening in the first fitting, the first tubular member, the flexible air hose, the second tubular member, and the opening in the second fitting, and for sealing the first fitting when disconnected and for providing the breathable gas when connected to the source of the breathable gas; and (v) a second quick connect and disconnect coupling on the second fitting for connecting the breathable gas to a pressure regulator as part of a firefighter's mask and for sealing the second fitting when disconnected, wherein the gas hose is able to withstand external water pressure in the water without collapsing and an internal pressure of the breathable gas of at least 125 psig; connecting the inlet adaptor of the hose apparatus to a water source; connecting the first quick connect and disconnect coupling to the source of breathable gas; and connecting the second quick connect and disconnect coupling to a pressure regulator on the mask by means of the flexible gas hose and providing the breathable gas to the firefighter from the hose apparatus through the pressure regulator on the mask by means of the flexible gas hose at least part of the time the firefighter is fighting the fire.

Further still, the present invention relates to a hose apparatus having an inlet adaptor having a first passageway, an outlet adaptor having a second passageway and connectable to a nozzle for dispensing water and a flexible water hose between the inlet and outlet adaptors, the improvement which comprises: a first fitting secured in a watertight connection through the inlet adaptor with an opening through the fitting into the first passageway and with a first tubular member which extends towards the water hose; a second fitting secured through the second adaptor in a watertight connection with an opening through the fitting into the second passageway with a second tubular member which extends towards the water hose, such that the first and second tubular members are open towards each other; a flexible gas hose for supplying a breathable gas connected between the tubular members inside of the water hose in a gas and watertight connection; a first coupling on the first fitting for connecting a source of breathable gas through the opening in the first fitting, the first tubular member, the flexible gas hose, the second tubular member, and the opening in the second fitting, and for sealing the first fitting when disconnected and for providing the breathable gas when connected to the source of the breathable gas; and a second coupling on the second fitting configured for connecting the breathable gas to a pressure regulator as part of a firefighter's mask and for sealing the second fitting when disconnected, wherein the gas hose is able to withstand an external water pressure between about 1000 to 2850 psig in the water hose without collapsing and an internal pressure of the breathable gas of at least 125 psig.

Still further, the present invention relates to a system for providing breathable air to a firefighter wearing a mask with an air pressure regulator along with providing water to fight a fire, the improvement which comprises: a hose apparatus having an inlet adaptor having a first passageway, an outlet adaptor having a second passageway and connectable to a nozzle for dispensing the water and a flexible water hose between and connected to the inlet and outlet adaptors, which includes: (i) a first fitting secured in a watertight connection through the inlet adaptor with an opening through the fitting into the first passageway and with a first tubular member which extends towards the water hose; (ii) a second fitting secured through the second adaptor in a watertight connection with an opening through the fitting into the second passageway with a second tubular member which extends towards the water hose, such that the first and second tubular members are open towards each other; (iii) a flexible hose for supplying a breathable gas connected between the tubular members inside of the water hose in a gas and watertight connection; (iv) a first quick connect and disconnect coupling on the first fitting for connecting a source of the breathable gas through the opening in the first fitting, the first tubular member, the flexible air hose, the second tubular member, and the opening in the second fitting, and for sealing the first fitting when disconnected and for providing the breathable gas when connected to the source of the breathable gas; and (v) a second quick connect and disconnect coupling on the second fitting for connecting the breathable gas to a pressure regulator as part of a firefighter's mask and for sealing the second fitting when disconnected, wherein the breathable gas hose is able to withstand an external water pressure between about 1000 to 2850 psig in the water hose without collapsing and an internal pressure of the breathable gas of at least 125 psig; and a coupling hose for connecting between the pressure regulator for the breathable gas and the second coupling so that the breathable gas can be supplied to the firefighter by the system while water is flowing through the water hose.

Further, the present invention relates to a method for fighting a fire which comprises: providing a hose apparatus having an inlet adaptor having a first passageway, an outlet adaptor having a second passageway and connectable to a nozzle for dispensing water and a flexible water hose between the inlet and outlet adaptors and further comprising: (i) a first fitting secured in a watertight connection through the inlet adaptor with an opening through the fitting into the first passageway and with a first tubular member which extends towards the water hose; (ii) a second fitting secured through the second adaptor in a watertight connection with an opening through the fitting into the second passageway with a second tubular member which extends towards the water hose, such that the first and second tubular members are open towards each other; (iii) a flexible gas hose for supplying a breathable gas connected between the tubular members inside of the water hose in a gas and watertight connection; (iv) a first quick connect and disconnect coupling on the first fitting for connecting a source of the breathable gas through the opening in the first fitting, the first tubular member, the flexible air hose, the second tubular member, and the opening in the second fitting, and for sealing the first fitting when disconnected and for providing the breathable gas when connected to the source of the breathable gas; and (v) a second quick connect and disconnect coupling on the second fitting for connecting the breathable gas to a pressure regulator as part of a firefighter's mask and for sealing the second fitting when disconnected, wherein the breathable gas hose is able to withstand external water pressure between about 1000 to 2850 psig in the water without collapsing and an internal pressure of the breathable gas of at least 125 psig; connecting the inlet adaptor of the hose apparatus to a water source; connecting the first quick connect and disconnect coupling to the source of breathable gas; and connecting the second quick connect and disconnect coupling to a pressure regulator on the mask by means of the flexible gas hose and providing the breathable gas to the firefighter from the hose apparatus through the regulator on the mask by means of the gas hose at least part of the time the firefighter is fighting the fire.

The substance and advantages of the present invention will become increasingly apparent by reference to the following drawings and the description.

DESCRIPTION OF THE PREFERRED EMBODIMENTS

Figure 1:
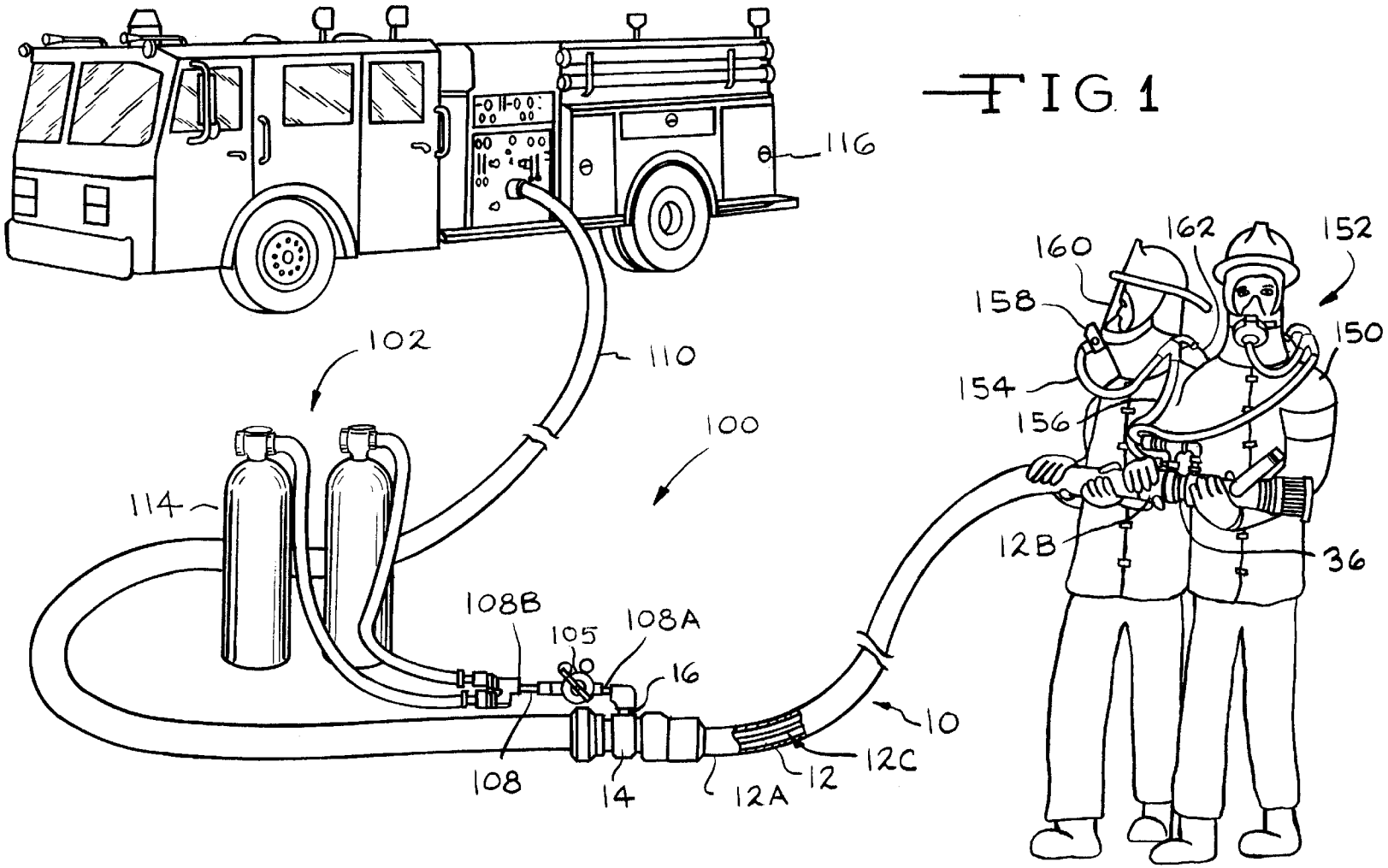
FIG. 1 is a perspective view of the system 100 showing the fire truck 116, the standard water hose 110, the air and water hose apparatus 10 and the firefighters 150.

FIG. 1 shows the air and water hose apparatus 10 of the present invention in use in an air supply system 100 to provide air or other breathable gas to firefighters 150. The air supply system 100 includes an air and water hose apparatus 10 connected at one (1) end to an air supply 102 and connected at the other end to a self-contained breathing apparatus (SCBA) 152 used by the firefighters 150. The air and water hose apparatus 10 includes a water hose 12 with a first end 12A and a second end 12B with an inner passageway 12C extending therebetween. An inlet adaptor or coupling 14 is mounted on the first or inlet end 12A of the water hose 12. An outlet coupling or adaptor 36 is mounted on the second or outlet end 12B of the water hose 12. The water hose 12 is preferably similar to standard firefighting water hoses and is preferably constructed of several layers of materials which are durable and flexible. The water hose 12, in the preferred embodiment, has an inner diameter of between about 1.25 inches and 2.75 inches (3.18 to 7.00 cm). The inlet adaptor 14 can be connected to a water source or can be connected to a standard firefighting water hose 110 if more than one (1) section of water hose is used. A nozzle 112, similar to any water hose nozzles well known in the art, is preferably provided on the end of the outlet adaptor 36 opposite the water hose 12.

Figure 2:
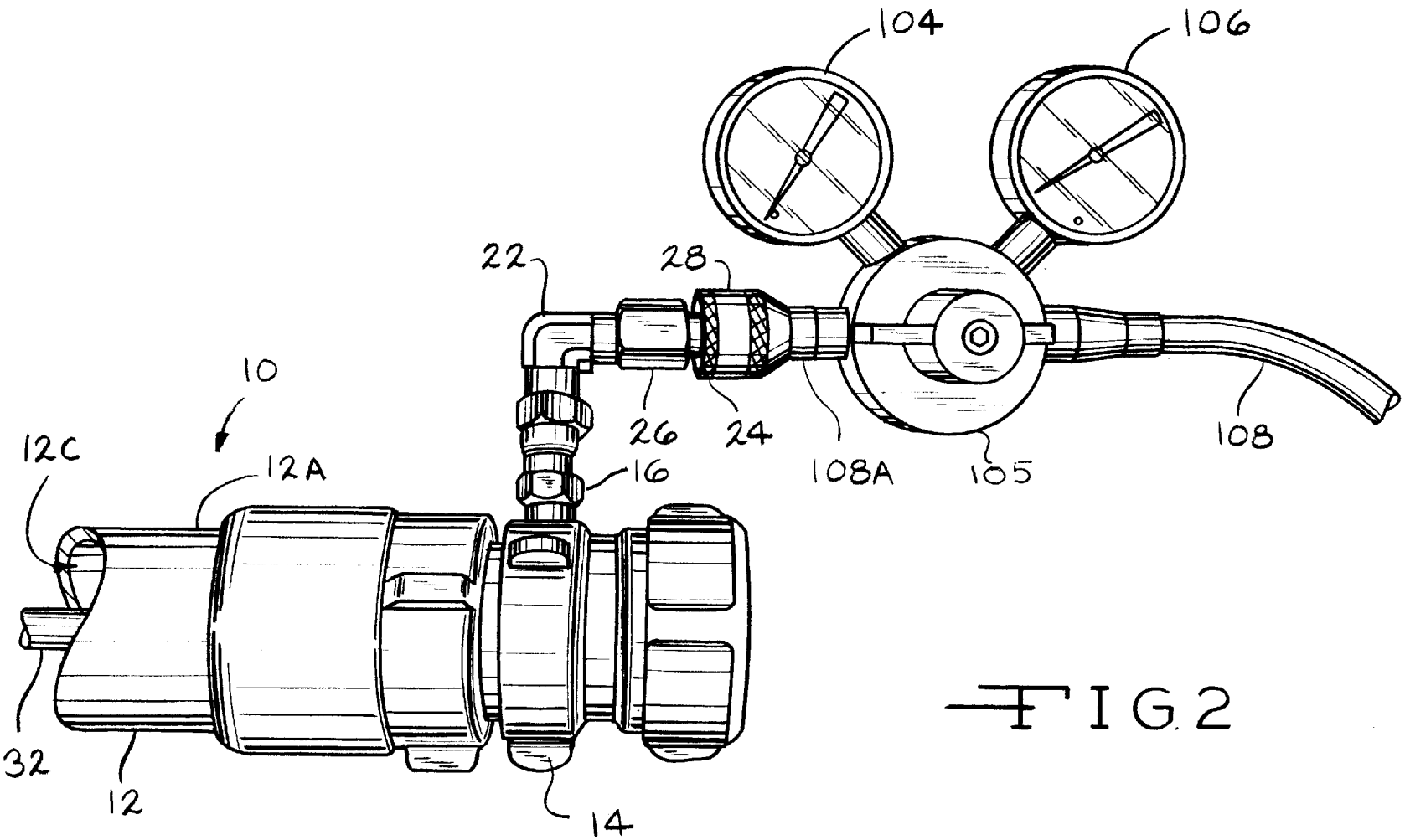
FIG. 2 is a partial side view of the inlet adaptor 14 showing the first fitting 16 and the gauges 104 and 106 for the air supply 102.
Figures 4, 5:
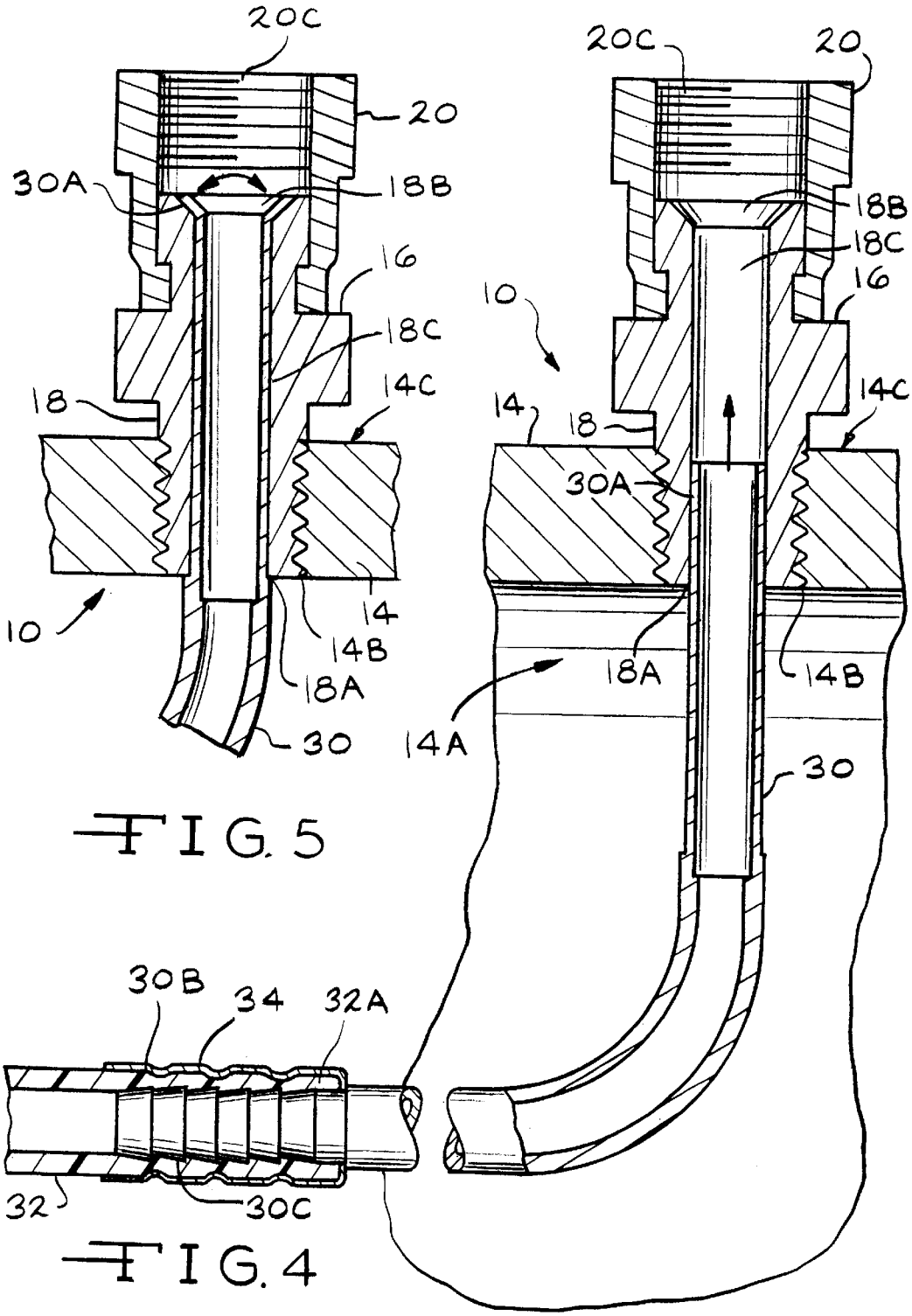
FIG. 4 is a cross-sectional view of the first fitting 16 showing the first tubular member 30 partially inserted into the first fitting 16.
FIG. 5 is a cross-sectional view of the first fitting 16 showing the first tubular member 30 fully inserted into the center bore 18C of the fixed portion 18 of the first fitting 16.

The inlet adaptor 14 at the first end 12A of the water hose 12 has opposed ends with a sidewall 14C extending therebetween and forming an inner first passageway 14A. The inner first passageway 14A is in fluid communication with the inner passageway 12C of the water hose 12. In the preferred embodiment, the inlet adaptor 14 is a swivel joint adaptor or coupling similar to those manufactured by Harrington. However, the inlet adaptor 14 could be similar to any standard adaptors well known in the art for use on standard water hoses for firefighters. A hole 14B is provided through the sidewall 14C of the inlet adaptor 14 and into the inner first passageway 14A of the adaptor 14. The hole 14B is preferably threaded. A first fitting 16 is preferably threadably mated into the hole 14A in the sidewall 14C of the inlet adaptor 14. It is understood that the fitting 16 may be mounted in the hole 14B of the inlet adaptor 14 by any well known means. The first fitting 16 and the inlet adaptor 14 could also be constructed as a single piece. The first fitting 16 is preferably a swivel fitting having a male to male fixed portion 18 and a female to female rotating portion 20 (FIGS. 4 and 5). The first fitting is preferably similar to a swivel valve manufactured by Harrington Weatherhead. The outer end 18A of the male to male fixed portion 18 is mounted in the hole 14B of the inlet adaptor 14. The fixed portion 18 has a center bore 18C between its ends 18A and 18B which is in fluid communication with a center bore 20C of the rotating portion 20. The inner end 18B of the fixed portion 18 adjacent the rotating portion 20 is preferably beveled to accommodate the first end 30A of the first tubular member 30 (to be discussed in detail hereinafter). The end 16B of the female to female rotating portion 20 opposite the male to male fixed portion 18 preferably has a threaded, female connector. In the preferred embodiment, a male to male elbow 22 is mounted in the female connector of the rotating portion 20 of the first fitting 16 (FIG. 2). The first fitting 16 and the elbow 22 could be constructed as a single unit. The swiveling ability of the first fitting 16 enables the female connector to be connected to other fittings without affecting the mounting of the first fitting 16 in the inlet adaptor 14 or the air hose 32 in the air and water hose apparatus 10. The first fitting 16 is sealingly mounted in the inlet adaptor 14 such that water and air can not escape from the inner first passageway 14A and the inlet adaptor 14 through the hole 14B around the first fitting 16.

In the preferred embodiment, a quick connect/disconnect coupling 24 is mounted to the other end of the male to male elbow 22 connected to the first fitting 16. The coupling 24 is preferably similar to the D series automatic connect, single shut off couplings manufactured by the Perfecting Coupling Company. The coupling 24 is preferably a ¼ NPT coupling constructed of brass or stainless steel. However, the coupling 24 can be similar to any pneumatic or hydraulic coupling able to handle the fluid pressures provided by the air supply 102. Preferably, the coupling 24 is able to handle up to 5000 psig. In the preferred embodiment, the coupling 24 includes a plug 26 and a socket 28 (FIG. 2). Preferably, the plug 26 is mounted on the male to male elbow 22. The socket 28 of the coupling 24 is mounted on one (1) end 100A of an air supply tube 108. In the preferred embodiment, the socket 28 of the coupling 24 has a valve (not shown) which is opened when the socket 28 is fitted over the plug 26 to allow fluid to flow through the coupling 24. When the socket 28 is removed from the plug 26, the valve in the socket 28 closes preventing fluid in the air supply tube 108 from escaping. In an alternate embodiment, the plug 26 also includes a valve (not shown) which is opened when the socket 28 is fitted over the plug 26. When the socket 28 is removed from the plug 26, the valve in the plug 26 closes preventing contamination to the air in the air hose 32. The socket 28 of the coupling 24 is mounted on one (1) end 100A of an air supply tube 108. The other end 100B of the air supply tube 108 is connected to the air supply 102 (FIG. 1). The air supply 102 is preferably two (2) portable air tanks 114. The use of two (2) air tanks allows an empty tank to be replaced without stopping the flow of air to the firefighters 150. However, the air supply 102 could be any number of air tanks. Alternatively, the air supply 102 could be mounted on the fire truck 116. The air supply 102 preferably is a high pressure air supply providing air at pressures between about 3000 and 5000 psig. In one (1) embodiment, a regulator 105 is preferably provided in the air supply tube 108 between the coupling 24 and the air supply 102 (FIG. 2). However, the regulator 105 could be provided at any point before the first fitting 16 such as on the top of the tanks 114. The regulator 105 reduces the pressure of the air exiting the tank 114 to between about 125 to 500 psig before it enters the coupling 24. In another embodiment, a regulator is not used. In this embodiment, the pressure of the air entering the coupling 24 is essentially equal to the pressure of the air exiting the tanks 114. Gauges 104 and 106 are preferably provided in the air supply tube 108 between the coupling 24 and the air supply 102. The gauges 104 and 106 measure the pressure of air flowing through the air supply tube 108 and into the coupling 24 and the amount of the air remaining in the tanks 114.

Figure 6:
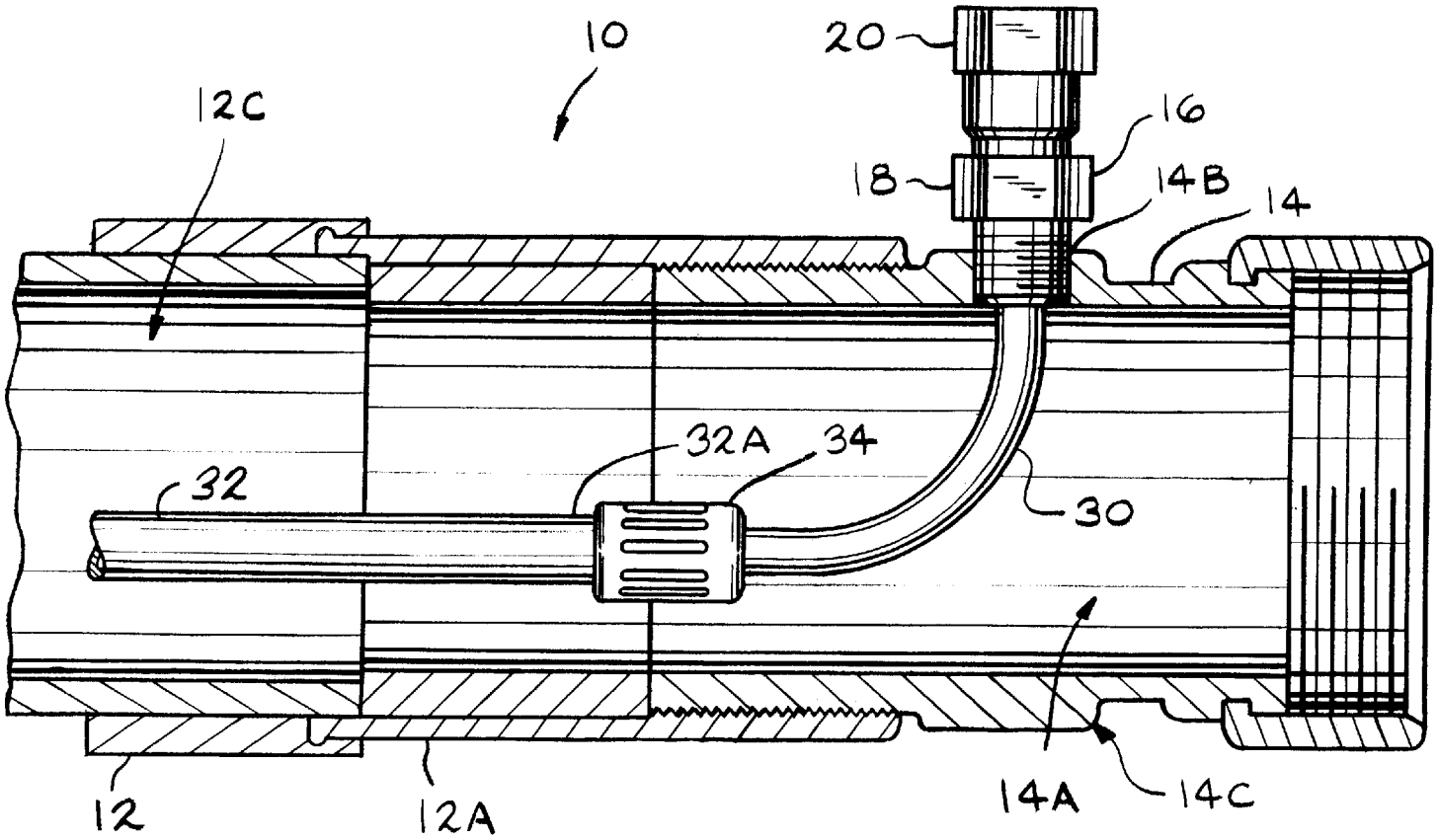
FIG. 6 is a cross-sectional view of the inlet adaptor 14 showing the first fitting 16, the first tubular member 30 and the air hose 32 in elevation.

A first tubular member 30 having opposed ends 30A and 30B connects the first fitting 16 to an air hose 32 in the inner passageway 12C of the water hose 12 (FIG. 6). The first end 30A of the first tubular member 30 is inserted into the outer end 18A of the center bore 18C of the first portion 18 of the first fitting 16 from the inner passageway 14A of the inlet adaptor 14 (FIG. 4). The first tubular member 30 is pushed completely through the center bore 18C such that the first end 30A of the first tubular member 30 extends beyond the inner end 18B of the center bore 18C of the fixed portion 18 of the first fitting 16 (FIG. 5). The first end 30A of the first tubular member 30 is then flared or flanged such that the first tubular member 30 can not be removed from the first fitting 16. In the preferred embodiment, the first end 30A of the first tubular member 30 is flanged such that the first end 30A of the first tubular member 30 is seated in the beveled inner end 18B of the fixed portion 18 of the first fitting 16. Flaring the first end 30A of the first tubular member 30 prevents air from escaping and to ensure the air provided to the firefighters 150 is uncontaminated. The insertion of the first tubular member 30 into the fixed portion 18 of the first fitting 16 preferably does not interfere with the swiveling ability of the first fitting 16. The inner diameter of the first tubular member 30 is preferably substantially constant along the length of the first tubular member 30. In the preferred embodiment, the first tubular member 30 is constructed of stainless steel and has an inner diameter of 0.1875 inch (0.4763 cm). The outer diameter of the portion of the first tubular member 30 inserted into the fitting 16 is preferably less than the outer diameter of the remainder of the first tubular member 30. The shoulder formed by the different outer diameters helps to determine how far the first tubular member 30 is inserted into the first fitting 16. In addition, the thinner sidewall at the first end 30A of the first tubular member 30 allows the first end 30A of the first tubular member 30 to be flanged easier. The first tubular member 30 extends outward from the first fitting 16 into the inner passageway 12C of the water hose 12. The first tubular member 30 is angled such as to extend toward the second end of the air and water hose apparatus 10. The second end 30B of the first tubular member 30 is inserted into the first end 32A of the air hose 32. Barbs 30C are provided on the second end 30B of the first tubular member 30 to help hold the second end 30B of the first tubular member 30 in the air hose 32(FIG. 4). A sleeve 34 is placed around the first end 32A of the air hose 32 having the first tubular member 30 and is crimped in place. It is understood that the first tubular member 30 and the air hose 32 can be connected together by any well known means which forms an airtight connection. The first tubular member 30 is preferably non-flexible and constructed of an anti-corrosive material such as stainless steel.

Figure 7:
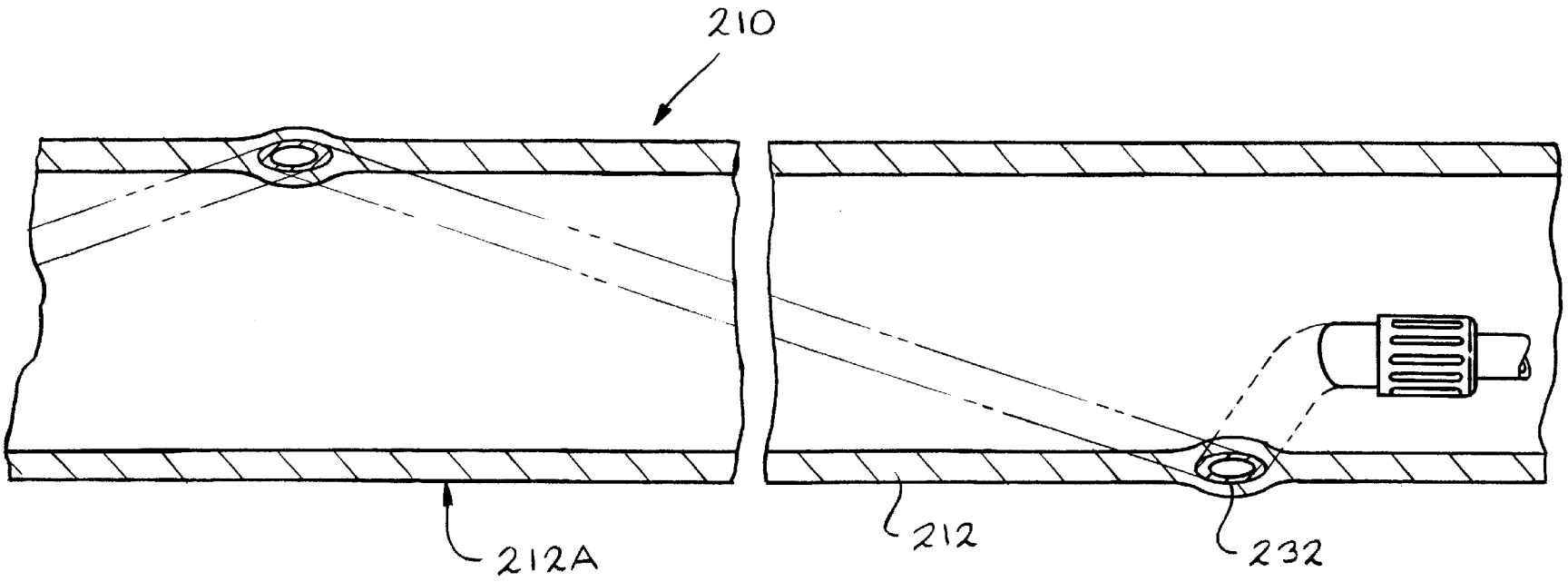
FIG. 7 is a cross-sectional view of an alternate embodiment with the air hose 232 within the sidewall 212A of the water hose 212.

The air hose 32 extends completely through the inner passageway 12C of the water hose 12 to the outlet coupling or adaptor 36 at the second end 12B of the water hose 12. In one (1) embodiment, the air hose 32 is separate from the water hose 12 and extends along the inner sidewall of the water hose 12. In an alternative embodiment, the air hose 232 and water hose 212 are constructed as an integral piece with the air hose 232 within the sidewall 12A or 212A of the water hose 12 or 212 (FIG. 7). The sidewall 212A of the water hose 212 is preferably constructed of several layers of material including at least an outer, durable weather resistant layer and an inner, flexible layer. The air hose 232 of the alternate embodiment is preferably sandwiched between the layers of the sidewall 212A of the water hose 212. The air hose 232 is preferably provided in a spiral pattern inside the sidewall 212A of the water hose 212. The spiraling of the air hose 232 allows the water hose 212 with the air hose 232 to be uniformly folded for storage. The air hose 232 also preferably has an elliptical cross-sectional shape which allows for bending and folding of the air and water hose apparatus 210 without crimping the air hose 232 within the sidewall 212A of the water hose 212. In this alternate embodiment, the air hose 232 spirals around in the inside of the sidewall 212A of the water hose 212 about 5 or 6 times for a water hose 212 having a length of about 50 feet (1524 cm). The remainder of the air and water hose apparatus 210 of the alternate embodiment is preferably similar to the air and water hose apparatus 10 of the preferred embodiment. In the preferred embodiment, the air hose 32 has a length essentially equal to the length of the water hose 12 without the adaptors 14 and 36 and has an inner diameter of about 0.25 inches (0.64 cm). The air hose 32 or 232 may be constructed of any well known material which can withstand high fluid pressure on the outside caused by the flow of water through the water hose 12 or 212 and high fluid pressure on the inside caused by the air moving through the air hose 32 or 232. In the preferred embodiment, the air hose 32 or 232 is able to withstand external pressure of up to about 3000 psig produced by water moving through the water hose 12 and is capable of carrying air at between about 125 and 5000 psig. Also preferably, the air hose 32 or 232 is constructed of a material which does not have memory. The air hose 32 or 232 must be supple enough to bend 180° and still spring back to its original shape to prevent damage to the air hose 32 or 232 due to repeated bending and folding for storage. The air hose 32 or 232 must also be constructed of a material which will not contaminate the air such as air hoses used and approved for scuba diving.

Figure 3:
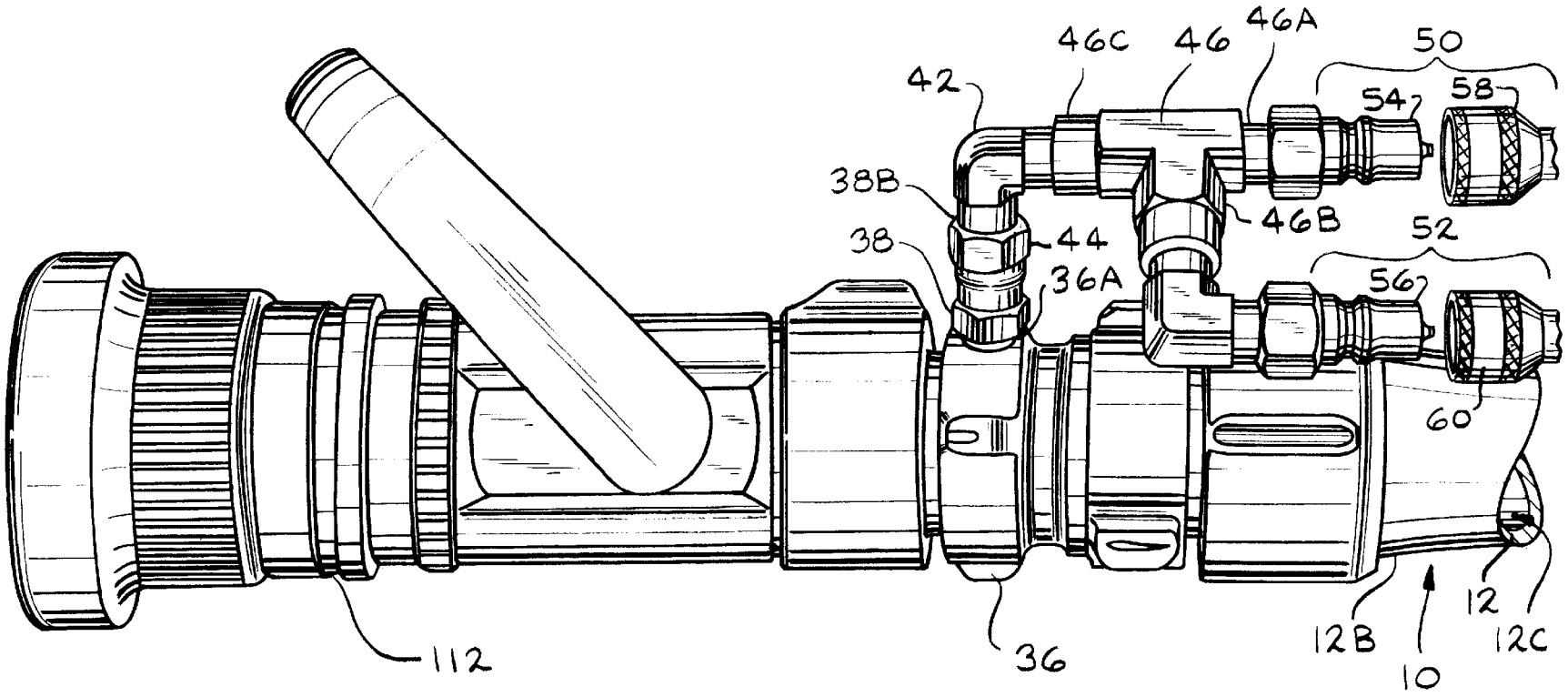
FIG. 3 is a partial side view of the outlet adaptor 36 showing the second fitting 38 and the branched conduit 46.

The outlet adaptor 36 is also provided with a hole 36A into which is secured a second fitting 38. The second fitting 38 is preferably similar to the first fitting 16. A second tubular member (not shown) extends between the second fitting 38 and the second end (not shown)of the air hose 32. The connection of the second tubular member to the second fitting 38 and to the second end of the air hose 32 is preferably similar to the connection of the first tubular member 30 to the first fitting 16 and the first end 32A of the air hose 32. A male to male elbow 42 is preferably connected to the female connector of the rotating portion 44 of the second fitting 38 (FIG. 3). A branched conduit or connector 46 is threadably mated to the other end of the elbow 42. The second fitting 38, elbow 42 and branched conduit 46 could be constructed as one or more pieces. In the preferred embodiment, the branched conduit 46 has two (2) outlets 46A and 46B and one (1) inlet 46C with the inlet 46C connected to the elbow 42. The branched conduit 46 is preferably a T-shaped conduit and is preferably constructed of stainless steel. In the preferred embodiment, the branched conduit 46 allows two (2) firefighters 150 to connect to the same air and water hose apparatus 10. Each of the outlets 46A and 46B of the branched conduit 46 is preferably provided with a quick connect/disconnect coupling 50 and 52 having a plug 54 and 56 and a socket 58 and 60. The couplings 50 and 52 are preferably quick release couplings similar to the Hansen HK series couplings sold by Tuthill Coupling Group. However, it is understood that the couplings 50 and 52 can be similar to any couplings able to accommodate fluid pressures up to 5000 psig. It is understood that the couplings 50 and 52 can be similar to any quick release couplings well known in the art and able to accommodate fluid pressure similar to the fluid pressure provided by the air supply 102. In the preferred embodiment, the plugs 54 and 56 of the couplings 50 and 52 are preferably provided with a valve (not shown) which is opened when the socket 58 and 60 is fitted over the plugs 54 and 56 to allow fluid to flow through the couplings 50 and 52. When the socket 58 and 60 are removed from the plug 54 and 56, the valve closes preventing the air in the air hose 32 from escaping. In an alternate embodiment, the socket 58 and 60 are also provided with a valve which opens when the socket 58 and 60 is fitted over the plug 54 and 56 and which closes when the socket 58 and 60 is removed from the plugs 54 and 56. The closed valve prevents air in the second breathing hose 156 from escaping. The plugs 54 and 56 of the couplings 50 and 52 are preferably mounted on the outlets 46A and 46B of the branched conduit 46. The sockets 58 and 60 of the couplings 50 and 52 are preferably mounted on the ends of the second breathing hoses 156 for the self-contained breathing apparatus 152 of the firefighters 150. Alternatively, separate breathing hoses (not shown) can be provided which connect to the breathing apparatus 152 of the firefighter 150. The breathing apparatus 152 for the firefighter 150 preferably includes a first breathing hose 154, a second or buddy breathing hose 156, a regulator 158 and a mask 160 and at least one (1) air tank 162. In the preferred embodiment, the first breathing hose 154 extends between the air tank 162 and the regulator 158 and provides air from the tank 162 to the firefighter 150. In one (1) embodiment, the regulator 158 is directly mounted on the mask 160. The regulator 158 allows high pressure, compressed gas to be used as the air supply. Preferably, the second breathing hose 156 is connected at one (1) end to a Y-connector in the first breathing hose 154 and is connected at the other end to one (1) of the couplings 50 or 52 on the outlets 46A or 46B of the branched conduit 46.

The air and water hose apparatus 10 or 210 is preferably used in the primary breathing system or source of air for firefighters 150 during a fire. The air and water apparatus 10 or 210 is used as the last section of the water hose used by the firefighters 150. Limiting use of the air and water hose apparatus 10 to a single section of the water hose, eliminates the need to connect the air hoses 32 or 232 from several air and water hose apparatus 10 or 210 together. This reduces the risk of air leakage and also reduces the possibility of damage to the air hose 32 which could result in air leakage. Air leakage in high pressure compressed air systems could potentially be dangerous since the leaked air could feed the fire. Any number of standard water hoses 110 can be used to allow the needed length, provided the last hose is the air and water hose apparatus 10. In the preferred embodiment, the air and water hose apparatus 10 or 210 has a length of between 50 and 150 feet (127 and 254 cm). However, it is understood that the air and water hose apparatus 10 or 210 can be of any length. To use the air and water hose apparatus 10 or 210 in the air supply system 100, the inlet adaptor 14 of the air and water apparatus 10 or 210 is attached to the outlet adaptor of the last section of standard water hose 110. The inlet end of the standard water hose 110 is connected to a source of water. Alternatively, if only the air and water hose apparatus 10 or 210 is used, the inlet adaptor 14 of the air and water hose apparatus 10 or 210 is connected directly to a source of water. The air supply 102 is preferably positioned adjacent the inlet adaptor 14 of the air and water hose apparatus 10. The air supply tube 108 for the air supply 102 is then connected to the plug 26 on the first fitting 16 on the inlet adaptor 14 and the air supply 102 is turned on. In the preferred embodiment, the air supply 102 provides air at a pressure of at least 125 psig with or without the use of a regulator 105. However, it is understood that the pressure of the air entering the first fitting 16 must be great enough to provide sufficient air to the firefighters 150 at the other end of the air and water hose apparatus 10 or 210. How much pressure is needed would depend on the length of the air and water hose apparatus 10 or 210, the inner diameter of the air hose 32 or 232 and the number of persons using the air and water hose apparatus 10 or 210. It is believed that 125 psig is the lowest amount of pressure needed for use in a 50 ft air and water hose apparatus 10 or 210 used by two (2) persons. It is understood that other breathable gases could also be provided through the air hose 32 or 232 of the air and water hose apparatus 10 or 210. Next, the nozzle 112 connected to the outlet adaptor 36 of the air and water apparatus 10 is provided to one or more firefighters 150. Each firefighter 150 then connects the second breathing hose 156 of his breathing apparatus 152 to one of the plugs 54 or 56 on the outlets 46A or 46B of the branched conduit 46. It is understood that there could be numerous outlets on the branched conduit 46 to accommodate any number of firefighters 150. A secondary hose and mask (not shown) could also be connected to any remaining plug 54 or 56. The secondary hose and mask can then be used to provide air to a civilian trapped in a fire. Preferably, the firefighter 150 does not turn on the tanks 162 of the breathing apparatus 152 unless the air from the air and water apparatus 10 or 210 stops. Preferably, the air tanks 162 are not on when the air and water apparatus 10 or 210 is being used. In an alternative embodiment where the breathing apparatus does not have a second breathing hose, the firefighter 150 disconnects the single breathing hose from the tank 162 and connects the single breathing hose to the air and water hose apparatus 10 or 210. Once the firefighters 150 are connected to the air and water hose apparatus 10 or 210 and are holding the nozzle 112, the water supply is turned on. Preferably, the air supply 102 is turned on before the water supply such that the internal pressure of the air in the air hose 32 or 232 helps to compensate for the external pressure of the water. The water running through the water hose 12 or 212 is preferably at a pressure of between about 1000 and 2850 psig. The water pressure is preferably similar to that used in standard water hoses 110. It is understood that other firefighting fluids or flame retardant materials could also be provided through the water hose 12 or 212 of the air and water hose apparatus 10 or 210. The system 100 is preferably constructed such that the firefighter 150 breathes air or other breathable gas from the air and water hose apparatus 10 or 210 as long as the air supply 102 is available. Thus, a firefighter 150 would only use the air in the tank 162 of his breathing apparatus 152 which he carries, if the primary air supply 102 should be stopped.

It is intended that the foregoing description be only illustrative of the present invention and that the present invention be limited only by the hereinafter appended claims.

I claim:

1. In a hose apparatus having an inlet adaptor having a first passageway, an outlet adaptor having a second passageway and connectable to a nozzle for dispensing water and a flexible water hose between and connected to the inlet and outlet adaptors, the improvement which comprises:

(a) a first fitting secured in a watertight connection through the inlet adaptor with an opening through the first fitting into the first passageway and with a first tubular member which extends towards the water hose;

(b) a second fitting secured through the outlet adaptor in a watertight connection with an opening through the second fitting into the second passageway with a second tubular member which extends towards the water hose, such that the first and second tubular members are open towards each other;

(c) a flexible gas hose for supplying a breathable gas connected between the tubular members inside of the water hose in a gas and watertight connection;

(d) a first quick connect and disconnect coupling on the first fitting for connecting a source of the breathable gas through the opening in the first fitting, the first tubular member, the flexible gas hose, the second tubular member, and the opening in the second fitting, the first quick connect and disconnect coupling having a valve for sealing the first fitting when disconnected and for providing the breathable gas when connected to the source of the breathable gas; and (e) a second quick connect and disconnect coupling on the second fitting for connecting the breathable gas to a pressure regulator as part of a firefighter's mask, the second quick connect and disconnect coupling having a valve for sealing the second fitting when disconnected, wherein the gas hose is able to withstand an external water pressure in the water hose without collapsing and an internal pressure of the breathable gas of at least 125 psig.

2. The apparatus of claim 1 wherein two second quick disconnect couplings are provided on a branched conduit attached to the second fitting.

3. The hose apparatus of claim 1 wherein the hose apparatus is for firefighting.

4. The hose apparatus of claim 3 having a length which enables fighting a fire with a connection to at least one standard water hose.

5. The hose apparatus of claim 4 which is about 50 to 150 feet (1524 to 1803 cm) in length.

6. A system for providing breathable air to a firefighter wearing a mask with an air pressure regulator along with providing water to fight a fire, the improvement which comprises:

(a) a hose apparatus having an inlet adaptor having a first passageway, an outlet adaptor having a second passageway and connectable to a nozzle for dispensing the water and a flexible water hose between and connected to the inlet and outlet adaptors, and further comprising:

(i) a first fitting secured in a watertight connection through the inlet adaptor with an opening through the first fitting into the first passageway and with a first tubular member which extends towards the water hose;

(ii) a second fitting secured through the second adaptor in a watertight connection with an opening through the fitting into the second passageway with a second tubular member which extends towards the water hose, such that the first and second tubular members are open towards each other;

(iii) a flexible gas hose for supplying a breathable gas connected between the tubular members inside of the water hose in a gas and watertight connection;

(iv) a first quick connect and disconnect coupling on the first fitting for connecting a source of the breathable gas through the opening in the first fitting, the first tubular member, the flexible gas hose, the second tubular member, and the opening in the second fitting, the first quick connect and disconnect coupling having a valve for sealing the first fitting when disconnected and for providing the breathable gas when connected to the source of the breathable gas; and (v) a second quick connect and disconnect coupling on the second fitting for connecting the breathable gas to the air pressure regulator of the mask, the second quick connect and disconnect coupling having a valve for sealing the second fitting when disconnected, wherein the gas hose is able to withstand an external water pressure in the water hose without collapsing and an internal pressure of the breathable gas of at least 125 psig; and (b) a coupling hose for connecting between the air pressure regulator and the second quick disconnect coupling so that the breathable gas can be supplied to the firefighter by the system while water is flowing through the water hose.

7. The system of claim 6 wherein there are two second disconnect couplings provided on a branched conduit connected to the second fitting allowing a second firefighter with a second mask and a second air pressure regulator to connect to the system at one of the second disconnect couplings.

8. The system of claims 6 or 7 including a breathable gas tank worn by the firefighter, wherein the firefighter is able to switch between connection to the second disconnect coupling and the tank to alternately obtain air from the flexible gas hose for the breathable gas and from the breathable gas tank with the coupling hose.

9. The system of claim 6 wherein the source of the breathable gas is from a tank provided adjacent to the hose apparatus and connected to the first coupling.

10. The system of claim 6 having one hose apparatus.

11. The system of claim 10 wherein the one hose apparatus is configured to be connected to at least one standard water hose.

12. A method for fighting a fire which comprises the steps of:

(a) providing a hose apparatus having an inlet adaptor having a first passageway, an outlet adaptor having a second passageway and connectable to a nozzle for dispensing water and a flexible water hose between the inlet and outlet adaptors, and further comprising:

(i) a first fitting secured in a watertight connection through the inlet adaptor with an opening through the first fitting into the first passageway and with a first tubular member which extends towards the water hose;

(ii) a second fitting secured through the second adaptor in a watertight connection with an opening through the second fitting into the second passageway with a second tubular member which extends towards the water hose, such that the first and second tubular members are open towards each other;

(iii) a flexible gas hose for supplying a breathable gas connected between the tubular members inside of the water hose in a gas and watertight connection;

(iv) a first quick connect and disconnect coupling on the first fitting for connecting a source of the breathable gas through the opening in the first fitting, the first tubular member, the flexible gas hose, the second tubular member, and the opening in the second fitting, and for sealing the first fitting when disconnected and for providing the breathable gas when connected to the source of the breathable gas; and (v) a second quick connect and disconnect coupling on the second fitting for connecting the breathable gas to a pressure regulator as part of a firefighter's mask and for sealing the second fitting when disconnected, wherein the gas hose is able to withstand external water pressure in the water without collapsing and an internal pressure of the breathable gas of at least 125 psig;

(b) connecting the inlet adaptor of the hose apparatus to a water source;

(c) connecting the first quick connect and disconnect coupling to the source of breathable gas; and (d) connecting the second quick connect and disconnect coupling to a pressure regulator on the mask by means of the flexible gas hose and providing the breathable gas to the firefighter from the hose apparatus through the pressure regulator on the mask by means of the flexible gas hose at least part of the time the firefighter is fighting the fire.

13. The method of claim 12 wherein there are two second quick disconnect couplings provided on a branched conduit connected to the second fitting and wherein in step (d) a second firefighter with a second mask and a second pressure regulator connects to the hose apparatus at one of the second quick disconnect couplings.

14. The method of claim 12 wherein the source of the breathable gas is a tank and wherein the tank is positioned adjacent to the inlet adaptor of the hose apparatus.

15. The method of claim 12 wherein the breathable gas is at a pressure of between about 125 to 500 psig.

16. The method of claim 12 wherein an air gauge is provided between the source of breathable gas and the first quick connect and disconnect coupling and wherein the internal pressure of the breathable gas to be inserted through the gas hose is measured before a valve in the gas hose is opened.

17. The method of claim 12 wherein only one hose apparatus is provided.

18. The method of claim 17 wherein in step (b), the inlet adaptor of the hose apparatus is connected to one end of a standard water hose and wherein the other end of the standard water hose is connected to the water source.

19. In a hose apparatus having an inlet adaptor having a first passageway, an outlet adaptor having a second passageway and connectable to a nozzle for dispensing water and a flexible water hose between the inlet and outlet adaptors, the improvement which comprises:

(a) a first fitting secured in a watertight connection through the inlet adaptor with an opening through the first fitting into the first passageway and with a first tubular member which extends towards the water hose;

(b) a second fitting secured through the second adaptor in a watertight connection with an opening through the second fitting into the second passageway with a second tubular member which extends towards the water hose, such that the first and second tubular members are open towards each other;

(c) a flexible gas hose for supplying a breathable gas connected between the tubular members inside of the water hose in a gas and watertight connection;

(d) a first coupling on the first fitting for connecting a source of breathable gas through the opening in the first fitting, the first tubular member, the flexible gas hose, the second tubular member, and the opening in the second fitting, the first quick connect and disconnect coupling having a valve for sealing the first fitting when disconnected and for providing the breathable gas when connected to the source of the breathable gas; and (e) a second coupling on the second fitting configured for connecting the breathable gas to a pressure regulator as part of a firefighter's mask, the second quick connect and disconnect coupling having a valve for sealing the second fitting when disconnected, wherein the gas hose is able to withstand an external water pressure between about 1000 to 2850 psig in the water hose without collapsing and an internal pressure of the breathable gas of at least 125 psig.

20. The apparatus of claim 19 wherein two second quick disconnect couplings are provided on a branched conduit attached to the second fitting.

21. The apparatus of claim 19 having a length which enables fighting a fire with a connection to at least one standard water hose.

22. A system for providing breathable air to a firefighter wearing a mask with an air pressure regulator along with providing water to fight a fire, the improvement which comprises:

(a) a hose apparatus having an inlet adaptor having a first passageway, an outlet adaptor having a second passageway and connectable to a nozzle for dispensing the water and a flexible water hose between and connected to the inlet and outlet adaptors, which includes:

(i) a first fitting secured in a watertight connection through the inlet adaptor with an opening through the first fitting into the first passageway and with a first tubular member which extends towards the water hose;

(ii) a second fitting secured through the second adaptor in a watertight connection with an opening through the second fitting into the second passageway with a second tubular member which extends towards the water hose, such that the first and second tubular members are open towards each other;

(iii) a flexible hose for supplying a breathable gas connected between the tubular members inside of the water hose in a gas and watertight connection;

(iv) a first quick connect and disconnect coupling on the first fitting for connecting a source of the breathable gas through the opening in the first fitting, the first tubular member, the flexible air hose, the second tubular member, and the opening in the second fitting, the first quick connect and disconnect coupling having a valve for sealing the first fitting when disconnected and for providing the breathable gas when connected to the source of the breathable gas; and (v) a second quick connect and disconnect coupling on the second fitting for connecting the breathable gas to a pressure regulator as part of a firefighter's mask, the second quick connect and disconnect coupling having a valve for sealing the second fitting when disconnected, wherein the breathable gas hose is able to withstand an external water pressure between about 1000 to 2850 psig in the water hose without collapsing and an internal pressure of the breathable gas of at least 125 psig; and (b) a coupling hose for connecting between the pressure regulator for the breathable gas and the second coupling so that the breathable gas can be supplied to the firefighter by the system while water is flowing through the water hose.

23. The system of claim 22 wherein the source of the breathable gas is from a tank provided adjacent to the hose apparatus and connected to the first coupling.

24. The system of claim 22 wherein there are two second couplings provided on a branched conduit connected to the second fitting allowing a second firefighter with a second mask and a second pressure regulator to connect to the system at one of the second couplings.

25. The system of claims 22 or 24 including a breathable gas tank worn by the firefighter, wherein the firefighter is able to switch between connection to the second coupling and the tank to alternately obtain the breathable gas from the gas hose for the breathable gas and from the breathable gas tank with the coupling hose.

26. The system of claim 22 having one hose apparatus.

27. The system of claim 26 wherein the one hose apparatus is configured to be connected to at least one standard water hose.

28. A method for fighting a fire which comprises the steps of:

(a) providing a hose apparatus having an inlet adaptor having a first passageway, an outlet adaptor having a second passageway and connectable to a nozzle for dispensing water and a flexible water hose between the inlet and outlet adaptors, and further comprising:

(i) a first fitting secured in a watertight connection through the inlet adaptor with an opening through the first fitting into the first passageway and with a first tubular member which extends towards the water hose;

(ii) a second fitting secured through the second adaptor in a watertight connection with an opening through the second fitting into the second passageway with a second tubular member which extends towards the water hose, such that the first and second tubular members are open towards each other;

(iii) a flexible gas hose for supplying a breathable gas connected between the tubular members inside of the water hose in a gas and watertight connection;

(iv) a first quick connect and disconnect coupling on the first fitting for connecting a source of the breathable gas through the opening in the first fitting, the first tubular member, the flexible gas hose, the second tubular member, and the opening in the second fitting, and for sealing the first fitting when disconnected and for providing the breathable gas when connected to the source of the breathable gas; and (v) a second quick connect and disconnect coupling on the second fitting for connecting the breathable gas to a pressure regulator as part of a firefighter's mask and for sealing the second fitting when disconnected, wherein the breathable gas hose is able to withstand external water pressure between about 1000 to 2850 psig in the water without collapsing and an internal pressure of the breathable gas of at least 125 psig; and (b) connecting the inlet adaptor of the hose apparatus to a water source;

(c) connecting the first quick connect and disconnect coupling to the source of breathable gas; and (d) connecting the second quick connect and disconnect coupling to a pressure regulator on the mask by means of the flexible gas hose and providing the breathable gas to the firefighter from the hose apparatus through the pressure regulator on the mask by means of the gas hose at least part of the time the firefighter is fighting the fire.

29. The method of claim 28 wherein there are two second couplings provided on a branched conduit connected to the second fitting and wherein in step (d) a second firefighter with a second mask and a second pressure regulator connects to the hose apparatus at one of the second quick disconnect couplings.

30. The method of claim 28 wherein the source of the breathable gas is from a tank and wherein the tank is positioned adjacent to the inlet adaptor of the hose apparatus.

31. The method of claim 28 wherein the breathable gas is at a pressure of between about 125 to 500 psig.

32. The method of claim 28 wherein a pressure gauge attached to the hose apparatus provides a measure of the pressure of the breathable gas in the gas hose.

33. The method of claim 28 wherein only one hose apparatus is provided.

34. The method of claim 33 wherein in step b, the inlet adaptor of the hose apparatus is connected to one end of a standard water hose and wherein the other end of the standard water hose is connected to the water source.

35. In a hose apparatus having an inlet adaptor having a first passageway, an outlet adaptor having a second passageway and connectable to a nozzle for dispensing water and a flexible water hose between and connected to the inlet and outlet adaptors, the improvement which comprises:

(a) a first fitting secured in a watertight connection through the inlet adaptor with an opening through the first fitting into the first passageway and with a first tubular member which extends towards the water hose;

(b) a second fitting secured through the outlet adaptor in a watertight connection with an opening through the second fitting into the second passageway with a second tubular member which extends towards the water hose, such that the first and second tubular members are open towards each other;

(c) a flexible gas hose for supplying a breathable gas under pressure and connected between the tubular members inside of the water hose in a gas and watertight connection wherein the flexible gas hose has an inner diameter of less than or equal to 0.25 inch;

(d) a first quick connect and disconnect coupling on the first fitting for connecting a source of the breathable gas through the opening in the first fitting, the first tubular member, the flexible gas hose, the second tubular member, and the opening in the second fitting, and for sealing the first fitting when disconnected and for providing the breathable gas when connected to the source of the breathable gas; and (e) a second quick connect and disconnect coupling on the second fitting for connecting the breathable gas to a pressure regulator as part of a firefighter's mask and for sealing the second fitting when disconnected, wherein the gas hose is able to withstand an external water pressure in the water hose without collapsing and an internal pressure of the breathable gas of at least 125 psig.

* * * * *